United States Patent [19]

Campbell

[11] 4,383,656

[45] May 17, 1983

[54] MOUNTING ASSEMBLY FOR A ROLL OF SHEET MATERIAL

[76] Inventor: Eugene T. Campbell, 125 N. Leswing Ave., Saddle Brook, N.J. 07662

[21] Appl. No.: 309,226

[22] Filed: Oct. 7, 1981

[51] Int. Cl.[3] ..... B65H 19/00

[52] U.S. Cl. ..... 242/55.2

[58] Field of Search ..... 242/55.2, 55.3, 55.53, 242/68.1, 68.3, 68.4, 129.51, 129.53; 206/389

[56] References Cited

U.S. PATENT DOCUMENTS

| | | | |
|---|---|---|---|
| 3,034,739 | 5/1962 | Barger | 242/68.4 |
| 3,239,158 | 3/1966 | Levesque | 242/55.53 |
| 3,362,653 | 1/1968 | Carlisle | 242/55.2 |
| 3,392,928 | 7/1968 | Peterson | 242/55.53 |
| 3,464,568 | 9/1969 | Hexter | 211/105.6 |
| 3,601,328 | 8/1971 | McClung | 242/55.2 |
| 3,647,158 | 3/1972 | Feder | 242/55.2 |

*Primary Examiner*—Leonard D. Christian
*Attorney, Agent, or Firm*—John N. Bain; P. H. Kochanski

[57] ABSTRACT

There is disclosed a mounting assembly for positioning a roll of sheet material within a dispenser including oppositely aligned receiving sockets wherein said roll of sheet material is formed on a hollow core, comprising a first arbor member formed of flange member, a core insertion member coaxially mounted on the flange member and positionable in the hollow core of the roll of sheet material and a socket insertion member coaxially positioned on the flange member on a side opposite the core insertion member and positionably in one of the oppositely aligned sockets in the dispenser and a second arbor member comprised of a flange member with a centrally positioned orifice, mounted to a core insertion member having a cylindrically shaped chamber, positionable in the hollow core of the roll of sheet material, a socket insertion member including a collar disposed within the chamber of the core insertion member and having an end thereof extending through the orifice of the flange member and positionable in one of said oppositely aligned sockets in the dispenser, and a spring disposed in the chamber between an end portion of the core insertion member and the socket insertion member.

10 Claims, 3 Drawing Figures

MOUNTING ASSEMBLY FOR A ROLL OF SHEET MATERIAL

FIELD OF THE INVENTION

This invention relates to a mounting assembly for rolls of paper products, in particular to a mounting assemby for rolls of toilet tissue.

BACKGROUND OF THE INVENTION

Toilet tissue roll dispensers can be of two types. They can be positioned in a recess in a wall or the dispenser can extend outwardly from a wall. In either case the dispenser is constructed wherein, either on the sides of the recessed wall mounted dispenser or on arms of the dispenser extending outwardly from a wall, there are oppositely aligned sockets for receiving a mounting assembly which supports the roll of the toilet tissue.

Presently used mounting assemblies for a roll of toilet tissue with a carboard core consist either of a wooden spindle that extends through the cardboard core or a pair of arbor members inserted into the cardboard core. The wooden spindle has two telescoping ends which are inserted into the oppositely aligned sockets. The pair of arbor members are similar in that each arbor member rather than having a telescoping end consists of a plunger telescoped in a bore in a housing, which plunger has a nib adapted to be received in the oppositely aligned sockets, and a compression spring for urging the plunger outwardly relative to the housing.

In both instances problems arise in removing the cardboard core after the toilet tissue roll is used up. To remove the wooden spindle or the arbor members from the oppositely aligned sockets in the dispenser one must insert a finger on each side of the roll to attempt to compress either the telescoping part of the wooden spindle or the plunger apparatus of the arbor.

OBJECTS OF THE INVENTION

It is an object of the present invention to provide a novel mounting assembly for roll material.

Another object of the present invention is to provide a novel mounting assembly for rolls of toilet tissue.

A further object of the present invention is to provide a novel mounting assembly for rolls of toilet tissue that is easy to install and remove.

Yet another object of the present invention is to provide a novel mounting assembly for rolls of toilet tissue that only has one moving part.

Still yet another object of the present invention is to provide a novel mounting assembly for rolls of toilet tissue that have stationary flanges to ease removal.

SUMMARY OF THE INVENTION

These and other objects of the present invention are achieved by a mounting assembly for positioning a roll of sheet material within a dispenser including oppositely aligned receiving sockets wherein said roll of sheet material is formed on a hollow core, comprising a first arbor member formed of flange member, a core insertion member coaxially mounted on the flange member and positionable in the hollow core of the roll of sheet material and a socket insertion member coaxially positioned on the flange member on a side opposite the core insertion member and positionable in one of the oppositely aligned sockets in the dispenser and a second arbor member comprised of a flange member with a centrally positioned orifice, mounted to a core insertion member having a cylindrically shaped chamber, positionable in the hollow core of the roll of sheet material, a socket insertion member including a collar disposed within the chamber of the core insertion member and having an end thereof extending through the orifice of the flange member and positionable in one of said oppositely aligned sockets in the dispenser, and a spring disposed in the chamber between an end portion of the core insertion member and the socket insertion member.

BRIEF DESCRIPTION OF THE DRAWINGS

A better understanding of the present invention as well as other objects and advantages thereof, will become apparent upon consideration of the detailed disclosure thereof, especially when taken with the accompanying drawings, wherein.

DETAILED DESCRIPTION OF THE INVENTION

Figure 1:
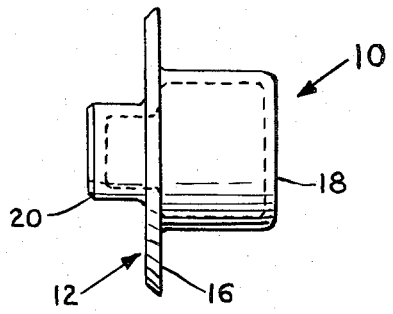
FIG. 1 is an elevational view of the stationary arbor member of the mounting assembly of the present invention.
Figure 2:
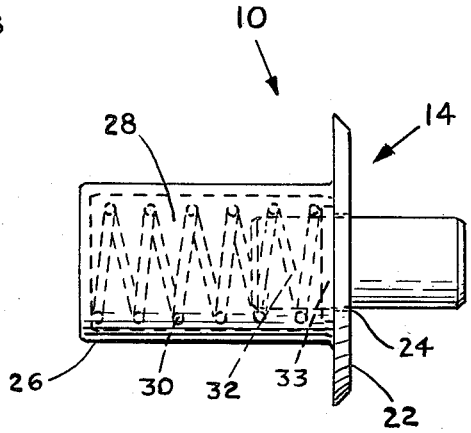
FIG. 2 is an elevational view of the spring-loaded arbor member of the mounting assembly of the present invention.

Referring now to FIGS. 1 and 2, there is shown a mounting assembly, generally indicated as 10, comprised of a stationary arbor member, generally indicated as 12, as shown in FIG. 1 and a spring-loaded arbor member, generaly indicated as 14, as shown in FIG. 2.

Stationary arbor member 12 is comprised of a flange 16, which preferably is of circular shape, a core insertion member 18, coaxially mounted on a side of said flange 16 and preferably of cylindrical shape and a socket insertion member 20, coaxially positioned on the flange 16 on the side opposite the core insertion member 18. Spring loaded arbor member 14 is comprised of a flange 22, preferably of circular shape, having a centrally positioned orifice 24. A core insertion member 26 including a cylindrically-shaped chamber 28 is coaxially mounted to one side of the flange 22. In the chamber 28 of the core insertion member 26 there is disposed a spring 30 in compression against a collar 33 of a socket insertion member 32 having an end thereof through the orifice 24 of the flange 22.

Figure 3:
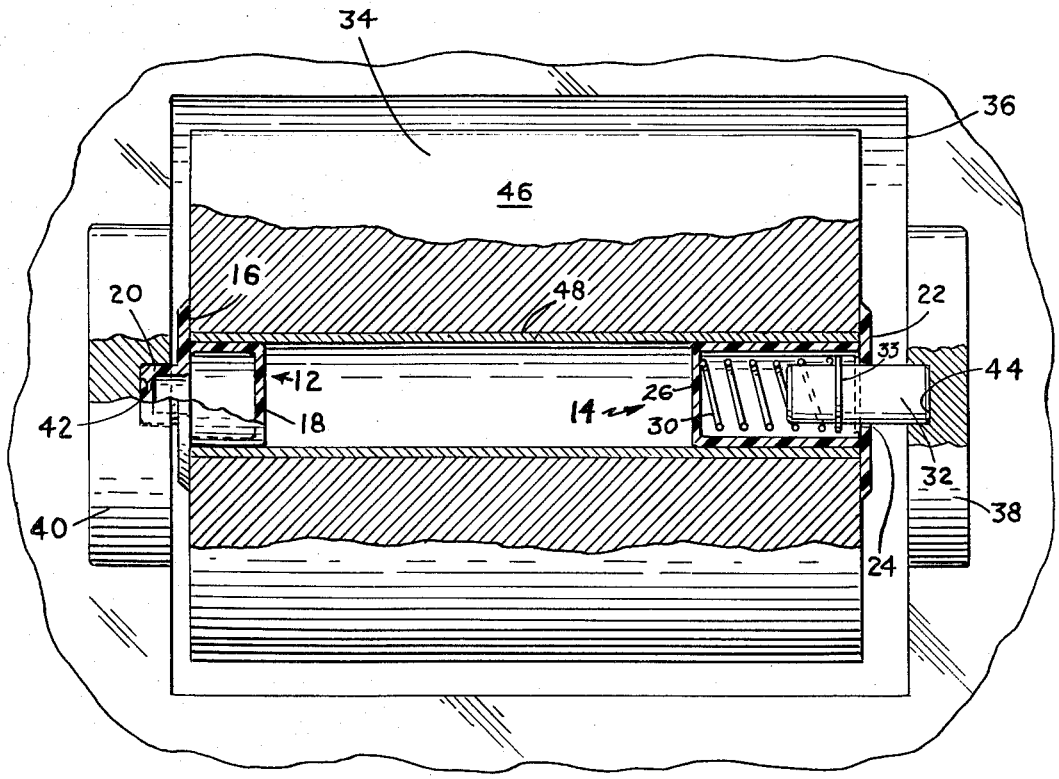
FIG. 3 is a sectional view of a roll of sheet mational and the dispenser with the mounting assembly positioned therein.

Referring now to FIG. 3, there is shown the mounting assembly 10 in combination with a roll of sheet material, generally indicated as 34, and a dispenser, generally indicated as 36.

The dispenser 36 is comprised of a pair of arms, 38 and 40 respectively, each having an oppositely aligned receiving socket 42 and 44 respectively, positioned thereon.

The roll of sheet material 34, such as toilet tissue or the like, consists of a roll of either a continuous sheet or individual sheets of material, generally indicated as 46, formed on a core 48, such as cardboard or the like.

Mounting of the roll of sheet material 34 on dispenser 36 is accomplished by use of the mounting assembly 10 as shown in FIG. 3. Core insertion member 18 of stationary arbor member 12 is positioned within one side of core 48. Core insertion member 26 of spring-loaded arbor member 14 is positioned within the opposite side of core 48 from stationary arbor member 12.

To insert the roll of sheet material 46, a user places socket insertion member 32 of spring-loaded arbor member 14 into receiving socket 44. Spring 30 is sufficiently compressed to allow insertion member 20 to freely pass over arm 40 until reaching receiving socket 42 wherein spring 30 releases and allows insertion member 20 to seat itself into receiving socket 42. In this position spring 30 is not completely released so as to avoid paper unwinding too freely. Some tension on spring 30 is maintained.

When the roll of sheet material 46 is exhausted, the user grasps the empty core 48 and pushes said core 48 to compress insertion member 32 and thereby releasing insertion member 20 from receiving socket 42.

Numerous modifications and variations of the above disclosed invention are possible in light of the above teachings and, therefore, within the scope of the appended claims the invention may be practiced otherwise than as particularly described.

What is claimed is:

1. A mounting assembly for positioning a roll of sheet material within a dispenser including oppositely aligned receiving sockets wherein said roll of sheet material is formed on a hollow core, which comprises:

(a) a first arbor member formed of a flange member, a core insertion member mounted on said flange member and a socket insertion member positioned on said flange member on a side opposite said core insertion member; and (b) a second arbor member comprised of a flange member having an orifice mounted to a core insertion member having a chamber, a socket insertion member including a collar disposed within said chamber of said core insertion member and having an end thereof extending through said orifice of said flange member and a spring disposed in said chamber between an end portion of said core insertion member and said socket insertion member.

2. The mounting assembly as defined in claim 1 wherein said core insertion member is coaxially mounted on said flange member of said first arbor member and said socket insertion member is coaxially positioned on said flange member on said said opposite said core insertion member of said first arbor member.

3. The mounting assembly as defined in claim 1 wherein said orifice formed on said flange member of said second arbor member is centrally positioned thereon.

4. The mounting assembly as defined in claim 1 wherein said chamber of said core insertion member is cylindrically-shaped.

5. The mounting assembly as defined in claim 1 wherein said flange members of said first arbor member and said second arbor member are disc shape and are of a diameter greater than said hollow core of said roll material.

6. The mounting assembly as defined in claim 1 wherein said collar on said socket insertion member of said second arbor member is intermediate of said ends on said socket insertion member and is disposed within said chamber of said core insertion member.

7. The mounting assembly as defined in claim 6 wherein said spring disposed in said chamber of said core insertion member is in compression against said collar of said socket insertion member.

8. The mounting assembly as defined in claim 1 wherein said portion of said socket insertion member of said second arbor member extending through said orifice is of a length greater than a depth of said socket in said dispenser.

9. The mounting assembly as defined in claim 1 wherein a distance between said ends of said socket insertion members of said first and second arbor members is greater than a distance between said sockets of said dispenser.

10. The mounting assembly as defined in claim 9 wherein said socket insertion member of said first arbor member extends into said socket of said dispenser a distance sufficient for mounting said roll of said sheet material in said dispenser yet to permit withdrawal of said socket insertion member of said first arbor member from said socket by exerting compressive force against said socket insertion member of said second arbor member.

* * * * *